US006321128B1

(12) United States Patent
Costin, IV et al.

(10) Patent No.: US 6,321,128 B1
(45) Date of Patent: Nov. 20, 2001

(54) VIRTUAL GOLF GAME

(76) Inventors: William Gilmore Costin, IV, 2012 W. St. Paul, #305, Chicago, IL (US) 60647; Breckenridge Wilson Kling, 850 W. Adams, Tower Suite, Chicago, IL (US) 60607

( * ) Notice: Subject to any disclaimer, the term of this patent is extended or adjusted under 35 U.S.C. 154(b) by 0 days.

(21) Appl. No.: 09/410,763

(22) Filed: Oct. 1, 1999

Related U.S. Application Data

(60) Provisional application No. 60/102,736, filed on Oct. 2, 1998, and provisional application No. 60/122,834, filed on Mar. 4, 1999.

(51) Int. Cl.[7] ..... A63F 9/24

(52) U.S. Cl. ..... 700/92; 473/131

(58) Field of Search ..... 473/131, 409; 463/1, 30, 36, 40, 42; 273/459, 460, 461, DIG. 26; 340/323 R; 700/91–92; 235/78 G, 88 G

(56) References Cited

U.S. PATENT DOCUMENTS 5,398,418 * 3/1995 Jones .
5,558,333 9/1996 Kelson et al. ..... 473/131
5,779,242 7/1998 Kaufmann ..... 273/459
5,779,549 7/1998 Walker et al. ..... 463/42
5,826,874 10/1998 Teitell et al. ..... 473/225
5,860,862 1/1999 Junkin ..... 463/40
5,906,547 5/1999 Tynan ..... 473/199

* cited by examiner

*Primary Examiner*—Mark Sager
(74) *Attorney, Agent, or Firm*—Kevin T. Duncan; Hunton & Williams

(57) ABSTRACT

A system and method adequately and accurately compares golf scores from two different courses by comparing the relative difficulty of each course played and the relative ability of the players in conjunction with a selected Tournament course, which may be an imaginary or physical course, for determining the winner of a match or game of golf. One method of practicing the present invention uses the USGA Handicap Index, Slope Rating system and Course Rating system to adjust the scores of the players and match the hole handicaps at the two or more courses. Next, the holes of the played courses (including the players' scores) and Tournament course are arranged by hole handicap, hardest to easiest. The final step involves comparing the scores relative to par to determine the score (for stroke play) or the winner of the hole (for match play). This process is repeated for the other holes until all 18 holes have been compared.

44 Claims, 9 Drawing Sheets

PEBBLE BEACH
PLAYER ONE'S
SCORE

| HOLE # | LENGTH | PAR |
|---|---|---|
| 1 | 303 | 4 |
| 2 | 487 | 5 |
| 3 | 439 | 4 |
| 4 | 366 | 4 |
| 5 | 156 | 3 |
| 6 | 338 | 4 |
| 6 | 538 | 5 |
| 7 | 103 | 3 |
| 8 | 405 | 4 |
| 9 | 395 | 4 |
| 10 | 388 | 4 |
| 11 | 341 | 4 |
| 12 | 175 | 3 |
| 13 | 373 | 4 |
| 14 | 439 | 5 |
| 16 | 374 | 4 |
| 17 | 184 | 3 |
| 18 | 553 | 5 |

FIG. 1A

AUGUSTA
PLAYER TWO'S
SCORE

| HOLE # | LENGTH | PAR |
|---|---|---|
| 1 | 320 | 4 |
| 2 | 455 | 5 |
| 3 | 145 | 3 |
| 4 | 365 | 4 |
| 5 | 375 | 4 |
| 6 | 165 | 3 |
| 7 | 380 | 4 |
| 8 | 455 | 5 |
| 9 | 380 | 4 |
| 10 | 450 | 4 |
| 11 | 405 | 4 |
| 12 | 155 | 3 |
| 13 | 505 | 5 |
| 14 | 365 | 4 |
| 15 | 460 | 5 |
| 16 | 170 | 3 |
| 17 | 350 | 4 |
| 18 | 340 | 4 |

FIG. 1B

LOCKHORNS
GOLF CLUB
TOURNAMENT
COURSE

| HOLE # | LENGTH | PAR |
|---|---|---|
| 1 | 307 | 4 |
| 2 | 136 | 3 |
| 3 | 459 | 5 |
| 4 | 375 | 4 |
| 5 | 172 | 3 |
| 6 | 412 | 4 |
| 7 | 475 | 5 |
| 8 | 383 | 4 |
| 9 | 395 | 4 |
| 10 | 343 | 4 |
| 11 | 159 | 3 |
| 12 | 355 | 4 |
| 13 | 534 | 5 |
| 14 | 403 | 4 |
| 15 | 191 | 3 |
| 16 | 366 | 4 |
| 17 | 510 | 5 |
| 18 | 431 | 4 |

FIG. 1C

STEP 1
PEBBLE BEACH
PLAYER ONE'S
SCORE

| HOLE # | LENGTH | SCORE |
|---|---|---|
| 7 | 103 | 2 |
| 5 | 156 | 2 |
| 12 | 175 | 3 |
| 17 | 184 | 5 |
| 1 | 303 | 6 |
| 6 | 338 | 5 |
| 11 | 341 | 4 |
| 4 | 366 | 4 |
| 13 | 373 | 4 |
| 16 | 374 | 3 |
| 10 | 388 | 3 |
| 9 | 395 | 4 |
| 8 | 405 | 4 |
| 3 | 439 | 5 |
| 14 | 439 | 5 |
| 2 | 487 | 6 |
| 6 | 538 | 5 |
| 18 | 553 | 6 |

FIG. 2A

STEP 1
AUGUSTA
PLAYER TWO'S
SCORE

| HOLE # | LENGTH | SCORE |
|---|---|---|
| 3 | 145 | 2 |
| 12 | 155 | 4 |
| 6 | 165 | 3 |
| 16 | 170 | 4 |
| 1 | 320 | 3 |
| 18 | 340 | 4 |
| 17 | 350 | 3 |
| 4 | 365 | 6 |
| 14 | 365 | 4 |
| 5 | 375 | 6 |
| 7 | 380 | 5 |
| 9 | 380 | 3 |
| 11 | 405 | 3 |
| 10 | 450 | 3 |
| 2 | 455 | 4 |
| 8 | 455 | 5 |
| 15 | 460 | 4 |
| 13 | 505 | 5 |

FIG. 2B

STEP 1
LOCKHORNS
GOLF CLUB
TOURNAMENT
COURSE

| HOLE # | LENGTH | PAR |
|---|---|---|
| 2 | 136 | 3 |
| 11 | 159 | 3 |
| 5 | 172 | 3 |
| 15 | 191 | 3 |
| 1 | 307 | 4 |
| 10 | 343 | 4 |
| 12 | 355 | 4 |
| 16 | 366 | 4 |
| 4 | 375 | 4 |
| 8 | 383 | 4 |
| 9 | 395 | 4 |
| 14 | 403 | 4 |
| 6 | 412 | 4 |
| 18 | 431 | 4 |
| 3 | 459 | 5 |
| 7 | 475 | 5 |
| 17 | 510 | 5 |
| 13 | 534 | 5 |

FIG. 2C

STEP 2
PLAYER ONE AND PLAYER TWO'S SCORES
COMPARED AGAINST LOCKHORNS
TOURNAMENT COURSE BY HOLE LENGTH

| HOLE # | LENGTH | PEBBLE BEACH PLAYER ONE SCORE | AUGUSTA PLAYER TWO SCORE |
|---|---|---|---|
| 2 | 136 | 2 | 2 |
| 11 | 159 | 2 | 4 |
| 5 | 172 | 3 | 3 |
| 15 | 191 | 5 | 4 |
| 1 | 307 | 6 | 3 |
| 10 | 343 | 5 | 4 |
| 12 | 355 | 4 | 3 |
| 16 | 366 | 4 | 6 |
| 4 | 375 | 4 | 4 |
| 8 | 383 | 3 | 6 |
| 9 | 395 | 3 | 5 |
| 14 | 403 | 4 | 3 |
| 6 | 412 | 4 | 3 |
| 18 | 431 | 5 | 3 |
| 3 | 459 | 5 | 4 |
| 7 | 475 | 6 | 5 |
| 17 | 510 | 5 | 4 |
| 13 | 534 | 6 | 5 |

FIG. 3

STEP 3
PLAYER ONE AND PLAYER TWO'S SCORES
ARRANGED BY HOLE NUMBER

| HOLE # | LENGTH | PEBBLE BEACH PLAYER ONE SCORE | AUGUSTA PLAYER TWO SCORE |
|---|---|---|---|
| 1 | 307 | 6 | 3 |
| 2 | 136 | 2 | 2 |
| 3 | 459 | 5 | 4 |
| 4 | 375 | 4 | 4 |
| 5 | 172 | 3 | 3 |
| 6 | 412 | 4 | 3 |
| 7 | 475 | 6 | 5 |
| 8 | 383 | 3 | 6 |
| 9 | 395 | 3 | 5 |
| 10 | 343 | 5 | 4 |
| 11 | 159 | 2 | 4 |
| 12 | 355 | 4 | 3 |
| 13 | 534 | 6 | 5 |
| 14 | 403 | 4 | 3 |
| 15 | 191 | 5 | 4 |
| 16 | 366 | 4 | 6 |
| 17 | 510 | 5 | 4 |
| 18 | 431 | 5 | 3 |

FIG. 4

| RE-ARRANGED HOLE # (HARDEST TO EASIEST) | COURSE A PAR | PLAYER ONE | COURSE B PAR | PLAYER TWO | STROKE PLAY SCORE (W/R/T PLAYER ONE) | MATCH PLAY SCORE |
|---|---|---|---|---|---|---|
| 1 | 4 | 5 | 4 | 5 | 0 | HALVE |
| 2 | 4 | 5 | 3 | 3 | -1 | PLAYER TWO |
| 3 | 5 | 5 | 4 | 4 | -1 | HALVE |
| 4 | 3 | 5 | 3 | 3 | -3 | PLAYER TWO |
| 5 | 4 | 4 | 4 | 4 | -3 | HALVE |
| 6 | 5 | 4 | 5 | 6 | -1 | PLAYER ONE |

FIG. 5

| RE-ARRANGED HOLE # (HARDEST TO EASIEST) | COURSE A PAR | PLAYER ONE | COURSE B PAR | PLAYER TWO | STROKE PLAY SCORE (W/R/T PLAYER ONE) | MATCH PLAY SCORE |
|---|---|---|---|---|---|---|
| 1 | 4 | 5-1=4 | 4 | 5 | + 1 | PLAYER ONE |
| 2 | 4 | 5-1=4 | 3 | 3 | +1 | HALVE |
| 3 | 5 | 5-1=4 | 4 | 4 | +2 | PLAYER ONE |
| 4 | 3 | 5-1=4 | 3 | 3 | +1 | PLAYER TWO |
| 5 | 4 | 4 | 4 | 4 | +1 | HALVE |
| 6 | 5 | 4 | 5 | 6 | +3 | PLAYER ONE |

FIG. 6

PLAYER A PLAYED AT COUNTRY CLUB OF X

| HOLE | HOLE HANDICAP | PAR | A'S SCORE | DIFFERENCE |
|---|---|---|---|---|
| 1 | 2 | 4 | 5 | 1 |
| 2 | 4 | 5 | 6 | 1 |
| 3 | 6 | 4 | 5 | 1 |
| 4 | 8 | 3 | 4 | 1 |
| 5 | 10 | 4 | 4 | 0 |
| 6 | 12 | 4 | 5 | 1 |
| 7 | 14 | 3 | 3 | 0 |
| 8 | 16 | 4 | 4 | 0 |
| 9 | 18 | 4 | 5 | 1 |
| 10 | 1 | 5 | 5 | 0 |
| 11 | 3 | 3 | 4 | 1 |
| 12 | 5 | 4 | 5 | 1 |
| 13 | 7 | 4 | 5 | 1 |
| 14 | 9 | 3 | 4 | 1 |
| 15 | 11 | 5 | 5 | 0 |
| 16 | 13 | 3 | 4 | 1 |
| 17 | 15 | 4 | 4 | 0 |
| 18 | 17 | 4 | 5 | 1 |
| TOTAL | | 70 | 82 | |

PLAYER B PLAYED COUNTRY CLUB OF Y

| HOLE | HOLE HANDICAP | PAR | B'S SCORE | DIFFERENCE |
|---|---|---|---|---|
| 1 | 18 | 4 | 5 | 1 |
| 2 | 16 | 4 | 4 | 0 |
| 3 | 14 | 5 | 5 | 0 |
| 4 | 12 | 4 | 5 | 1 |
| 5 | 10 | 3 | 5 | 2 |
| 6 | 8 | 4 | 4 | 0 |
| 7 | 6 | 4 | 3 | -1 |
| 8 | 4 | 5 | 6 | 1 |
| 9 | 2 | 4 | 5 | 1 |
| 10 | 17 | 3 | 4 | 1 |
| 11 | 15 | 4 | 4 | 0 |
| 12 | 13 | 4 | 4 | 0 |
| 13 | 11 | 3 | 4 | 1 |
| 14 | 9 | 5 | 5 | 0 |
| 15 | 7 | 4 | 5 | 1 |
| 16 | 5 | 3 | 5 | 2 |
| 17 | 3 | 5 | 4 | -1 |
| 18 | 1 | 4 | 6 | 2 |
| | | 72 | 83 | |

FIG. 8

* NOTE THAT MULTIPLE PLAYERS MAY ALSO COMPETE IN STROKE PLAY MATCHES OR TOURNAMENTS USING AN INDEPENDENT 'TOURNAMENT' COURSE THAT MAY NOT HAVE BEEN PHYSICALLY PLAYED BY ANY OF THE PARTICIPANTS.

A VS. B USING B'S COURSE AS THE 'MATCH' COURSE (COUNTRY CLUB X)

| HOLE # | HOLE HANDICAP | B PAR DIFFERENCE | A PAR DIFFERENCE | STROKE PLAY B IS | MATCH PLAY B IS: |
|---|---|---|---|---|---|
| 1 | 18 | 1 | 1 | EVEN | EVEN |
| 2 | 16 | 0 | 0 | EVEN | EVEN |
| 3 | 14 | 0 | 0 | EVEN | EVEN |
| 4 | 12 | 1 | 1 | EVEN | EVEN |
| 5 | 10 | 2 | 0 | DOWN 2 STROKES | 1 DOWN |
| 6 | 8 | 0 | 1 | DOWN 1 STROKE | EVEN |
| 7 | 6 | -1 | 1 | UP 1 STROKE | 1 UP |
| 8 | 4 | 1 | 1 | UP 1 STROKE | 1 UP |
| 9 | 2 | 1 | 1 | UP 1 STROKE | 1 UP |
| 10 | 17 | 1 | 1 | UP 1 STROKE | 1 UP |
| 11 | 15 | 0 | 0 | UP 1 STROKE | 1 UP |
| 12 | 13 | 0 | 1 | UP 2 STROKES | 2 UP |
| 13 | 11 | 1 | 0 | UP 1 STROKE | 1 UP |
| 14 | 9 | 0 | 1 | UP 2 STROKES | 2 UP |
| 15 | 7 | 1 | 1 | UP 2 STROKES | 2 UP |
| 16 | 5 | 2 | 1 | UP 1 STROKE | 1 UP |
| 17 | 3 | -1 | 1 | UP 3 STROKES | 2 UP |
| 18 | 1 | 2 | 0 | UP 1 STROKE | 1 UP |

FIG. 9

VIRTUAL GOLF GAME

CROSS REFERENCE TO RELATED APPLICATIONS

This application claims the benefit under Title 35, U.S.C. § 119(e) of U.S. Provisional Patent Applications assigned Ser. No. 60/102,736, filed Oct. 2, 1998, and Ser. No. 60/122,834, filed Mar. 4, 1999, both entitled VIRTUAL GOLF GAME.

FIELD OF THE INVENTION

The present invention relates to a method for determining one or more scores of one or more virtual games of golf based on the actual scores of two or more players from different courses, and which may be implemented electronically through an interconnected network, such as an on-line server through a web site.

BACKGROUND OF THE INVENTION

A problem arises when two or more golfers living hundreds of miles apart, or even golfers who play different courses within the same community, wish to play each other in a game of golf and compete head-to-head or by teams. For instance, each player may be a member of a different golf course or club. Typically, each player plays at his or her local golf course, but finds it impractical to travel hundreds of miles simply to play against a friend. Even those players living in the same community have no indisputable, objective method to compare scores achieved at different courses within the same community. While players may compare scores with each other, the two or more golf courses may greatly differ and the scores cannot be directly compared. The two or more golfers may have previously established handicaps, United States Golf Association ("USGA") Handicap Index, and may have even attempted to compare their golf scores based on the USGA Slope Rating and Course Rating systems, but this requires making numerous calculations and is seldom if ever done and is generally not entirely accurate in terms of who would win if the players played a game or tournament on the same course.

Existing internet games allow individuals to compete in a limited fashion in what is known as "fantasy leagues." Typical fantasy golf games involve users selecting a foursome for each tournament from qualified professional players. Users draft real-life professional players as members of their fantasy teams. This provides a way for individuals to compete against each other to see who has superior managing skills in any given sport, such as golf. Users may compete against friends, family members and co-workers by forming their own private division or league. However, these programs do not provide a way to compare user's real golf scores played on different golf courses.

Some existing golf games involve software applications and are generally directed towards virtual golf simulations. Users play golf in the virtual world via computers and/or a network of computers. The golf game system simulates the speed and the direction of a golf swing. The user swings a real golf club while the computer, software and other devices sense and interpret the swing and enter and display results via the software package. Although the game might seem highly realistic in some aspects, an actual round of golf under actual playing conditions is never played.

U.S. Pat. No. 5,779,549 (Walker et al.) is directed towards a database-driven online distributed tournament system. This patent discloses a method for an online tournament in which many remotely located players participate in a tournament through input/output devices connected to a central controller that manages the tournament. Electronic tournaments allow players to compete at a virtual location at any time. Thus, participants are not required to travel and coordinate a time and place to meet. This patent discloses a method for collecting entry fees and payment of prizes and allows for the coordination of multiple tournaments. However, this patent does not involve actual golf scores achieved at actual golf courses by the players and does not disclose a method of comparing golf scores played on different golf courses.

SUMMARY OF THE INVENTION

The present invention provides a unique system and method that enables two golfers or teams of golfers who play on different courses to compete on a virtual golf course, or Tournament course. The invention provides a method where one or more actual scores, i.e., scores achieved by a player playing a round of golf on a real golf course, not an electronic or other simulated game of golf, from one or more courses may be compared based on various factors, such as USGA Slope Ratings and Course Ratings systems. The Tournament course is used to objectively relate for comparison the players' actual scores and may be (i) an imaginary course, (ii) one of the courses played by the golfers, or (iii) another physical course on which none of the golfers played, a "neutral" course. If the scores are converted to a course, the Tournament course, on which at least one golfer played, the invention system converts the golfers' scores that did not play on such course to a score for the Tournament course for head-to-head or team-to-team comparison. In other words, when applying the present invention to two golfers' scores, it is possible to convert one of the golfer's score to the course played by the other golfer, the Tournament course.

In one embodiment of the present invention, after each player has played a game of golf, the scores are arranged by hole length for each given course; after which the scores are transferred to the Tournament course which has also been arranged by hole length, shortest to longest. Once the scores have been transferred to the Tournament course and the Tournament course rearranged by hole number, the players can then apply their USGA handicaps according to the hole handicaps to adjust the scores. The apportionment of the hole handicaps may be applied in a variety of different ways, including by hole length or by other methods. In one manner, the respective scores may be compared based on "par" for the hole actually played. By basing the scores off par, the inventive method avoids discrepancies which occur from course to course caused by differing course make-up of par threes, par fours and par fives.

After the conversion of the scores, the players end up with predicted scores for a Tournament course based on their past scores at different courses. This idea can be further implemented into so-called "virtual tournaments" in which players from all over the country may compete against each other simply by submitting their scores from USGA approved courses in their locality. While the above description calls for converting each of the golfer's scores to a Tournament course, it will be recognized that it is not necessary to convert every golfer's score if one of the courses on which the golfers played is used as the Tournament course.

According to a preferred embodiment of the present invention, and by way of example and not limitation, the collection and conversion of the scores and the display of the Tournament course are implemented through a web site. Two or more players or teams of players having Internet access may play against each other even though they live hundreds of miles apart. The present invention is not limited to Internet use, but may also be accessed through intranet, Ethernet or any system comprising a network of computers, or software applications.

In another embodiment of the present invention, the player and course handicap adjustment and course rating adjustment are calculated based on one or more of the USGA Handicap Index, Slope Rating and Course Rating. Next, the holes of the played courses and the Tournament course are arranged by hole handicap, most challenging to least challenging. The players' scores are then adjusted by the number of strokes determined by the adjustment calculations. Finally, the scores are compared relative to par to determine the winning player or team.

In another embodiment of the present invention, the holes are adjusted by handicap and then by hole number against the Tournament course. After such adjustment, the players may play match play, a hole-by-hole contest in which each hole is won based on the best score relative to par on each hole actually played (i.e., eagle, birdie, par, bogie, double bogie). The winner of the match is determined by summing the total number of holes won by each player.

Although many of the embodiments describe a method for comparing the scores of a plurality of players' scores, the present invention may also be used to take a single player's score from one course and predict what that score would have been at a different course.

Other features and their advantages will be apparent to those skilled in the art from a careful reading of the Detailed Description of the Preferred Embodiments accompanied by the following drawings.

BRIEF DESCRIPTION OF THE DRAWINGS

FIG. 1A is a table showing a sample course layout or description including hole number, length of hole, and par rating for each hole for a first course;

FIG. 1B is a table showing a sample course layout our description including hole number, length of hole, and par rating for each hole for a second course;

FIG. 1C is a table showing a sample course description including hole number, length of hole, and par rating for each hole for the Tournament course;

FIGS. 2A–2C is a table illustrating Step 1 of the first embodiment in which the three courses of FIGS. 1A–1C are rearranged by hole length;

FIG. 3 is a table illustrating Step 2 of the first embodiment in which the players' scores for each played course are compared against the Tournament course arranged by hole length;

FIG. 4 is a table illustrating Step 3 of the first embodiment in which the results from FIG. 3 are arranged by sequential hole number;

FIG. 5 is a table illustrating an example of a second embodiment of the present invention in which two partial round scores achieved at two different golf courses are compared after the holes have been re-arranged by hole handicap, hardest to easiest;

FIG. 6 is a table illustrating how the handicap calculations in TABLE 1 are used to convert and accurately compare two golfers' scores from two different golf courses;

FIG. 8 is a table illustrating a hypothetical game employing the method of the present invention; and FIG. 9 is a table further illustrating the hypothetical game of FIG. 8.

DETAILED DESCRIPTION OF THE PREFERRED EMBODIMENTS

Figure 7:
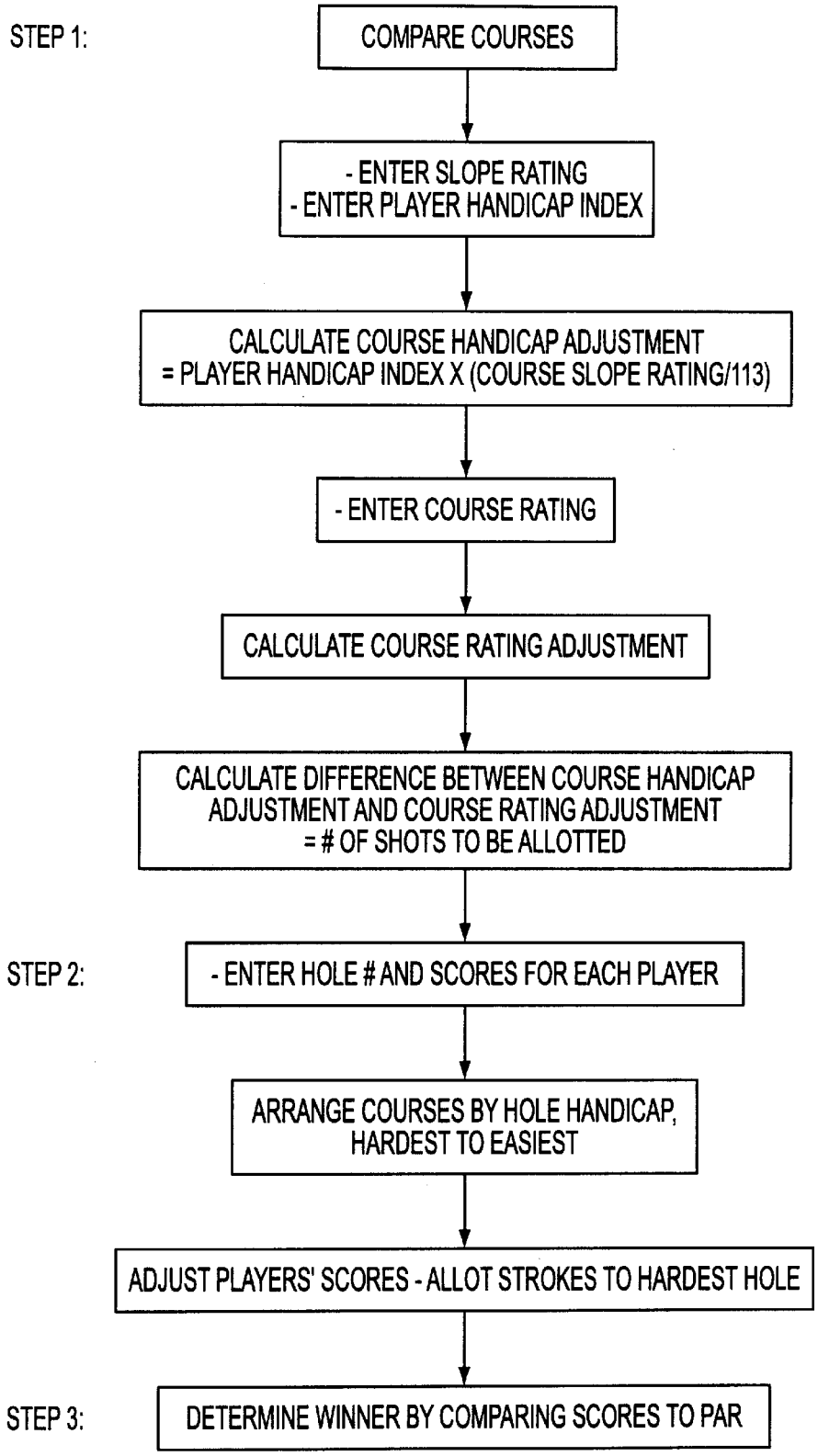
FIG. 7 is a flow chart illustrating the conversion and comparison process according to the second embodiment of the present invention.

The present invention, as shown and described in various embodiments below and in the drawings, provides a means and a method whereby one or more actual scores from one or more courses may be compared based on a variety of factors, such as USGA Handicap Index, Slope Ratings, Course Ratings, and weather conditions. By taking the relative difficulty of the courses played and the virtual Tournament course, the present invention provides a way to compare the scores of players playing on different courses and arrive at a winner in a virtual tournament or game.

Preferably, the information provided includes the score of each player and the hole, slope (for the particular set of tees played) and may include other information associated with each course played. FIGS. 1A–1C illustrate an example of one embodiment of the present invention in which two players, Player 1 and Player 2, have played a round of golf at two different golf courses. To determine which player had the best round of golf, the scores are compared on a "Tournament" course. The Tournament course information (FIG. 1C) is also needed as it will be the course to which the players' scores are converted. The Tournament course is used to gauge the players' scores and may be (i) an imaginary course, (ii) one of the courses played by at least one of the golfers, or (iii) another physical course on which none of the golfers played, a "neutral" course. If the scores are converted to a course on which at least one golfer played, it is only necessary to convert the golfers' scores that did not play on the selected course. For purposes of this description, "different golf courses," or like terms, includes different golf courses and different sets of tees, or tee boxes, at the same course or club. For instance, a score on the "white" tees, having a certain course and slope rating, may be compared with a score on the "gold" tees, having a different slope and course rating, at a given course, as contemplated by the present invention.

In addition to the selection of and information about the Tournament course, the players enter their scores and information about the golf courses which were played. In the preferred embodiment of the present invention, this information is collected from the golfers through a web site or through another means for collecting information (e.g., telephone or any other means for communicating data). Particular course information may be maintained in or accessed from a database, rather than requiring a player to input such course information.

The following description of the conversion of the golf scores assumes that the Tournament course is an imaginary course or actual physical course on which none of the golfers played. However, if one of the courses on which at least one of the golfer's played is selected as the Tournament course, it will only be necessary to convert those scores of the golfers that did not play on the chosen Tournament course.

After the score and course information have been obtained, the conversion can be accomplished in three general steps. The first step, Step 1, is shown in FIGS. 2A–2C and involves arranging the holes of the played course(s) (including the players' scores) and Tournament course of FIGS. 1A–1C by hole length, from shortest to longest. The next step, Step 2, is shown in FIG. 3, in which the sorted players' scores are compared relative to par of the Tournament course which is also sorted by hole length, from shortest to longest. The final step, Step 3, is shown in FIG. 4 and involves rearranging the player's scores by the hole numbers of the Tournament course. If processed individually, the above process is repeated for the second player's score assuming this player did not play on the Tournament course. (FIGS. 2A–2C)

In another embodiment of the present invention, the scores are adjusted based on the type of course played. First, the USGA Handicap Index, Slope Rating and Course Rating are used to match the hole handicaps at the two courses. Next, the holes of the played course (including the player's score) and Tournament course are arranged by hole handicap, hardest to easiest. The final step involves comparing the scores relative to par to determine the score (for stroke play) or the winner of the hole (for match play). This process is repeated for each hole.

The hole handicap ranks the holes on a golf course from hardest to easiest. When two players of differing handicaps play against each other, the holes on which the player with a higher handicap is allotted strokes depends on the ranking of holes. Accordingly, it is necessary to determine the relative hole handicaps so that the golfer's score may be adjusted depending on the hole. The hole handicaps may be apportioned on the Tournament course in a variety of different ways. For example, the holes may be ranked hardest to easiest by the length of the hole. The shorter the hole the easier the hole. However, using this method does not always work well considering that certain short holes may be much more difficult than certain longer holes. Accordingly, the hole handicaps can also be applied in other ways as described below. The order of the holes may be of great consequence where players have entered into some form of friendly betting. The process of arranging the holes and scores based off of a Tournament course can have a great effect on the outcome of a bet, particularly where mechanisms such as "pressing" or "automatic pressing" is involved.

When the Tournament course is arranged by hole lengths (and thus grouped by the par for the hole) the hole handicaps can be applied by having the longest par five the hardest hole, the longest par four being the second hardest hole, the longest par three being the third hardest hole, the second longest par five being the fourth hardest hole and so forth, until all of the holes have a hole handicap. In addition, the allocation of handicaps can be reversed so that the hardest hole is the longest par three. Those of ordinary skill in the art will recognize that other methods of applying hole handicaps can be developed and used without departing from the spirit and scope of the present invention.

The USGA Handicap Index, Slope Rating and Course Rating may be applied to adjust the handicaps for the players up or down depending on the difficulty of the courses played and the ability of the players. The Course Rating is representative of the playing difficulty of a course for a scratch golfer under normal playing and weather conditions. It is expressed as the number of strokes and is taken to one decimal point. For example, the Pebble Beach golf course in the example may have a course rating of 73.7. The Slope Rating rates the relative difficulty of a course and ranges from 55–155 where the higher the slope rating, the harder the course. The average Slope Rating for all United States courses is 113. Slope Ratings have more of an effect on the player who has a higher handicap, as opposed to a single digit handicap player.

In the example of Table 1, one embodiment of the present invention applies the USGA Handicap Index, Slope Rating and Course Rating to match the hole handicaps at the courses played and approximate a competitive round of golf on a designated course. The players' scores are aligned and matched with the Tournament course. The following table illustrates the course handicap adjustment.

TABLE 1

| Player | Course | Course Slope Rating | Player Handicap Index | Course Handicap | Course Rating | Total Shots |
|---|---|---|---|---|---|---|
| Player One | Gulf Stream | 126 | 8.6 | 10 | 70.7 | |
| Player Two | Merion | 148 | 2.2 | 3 | 73.5 | |
| Shots Player One gets from Player Two | | | | +7 | −2.8 | +4.2 = 4 shots |

In this example, Player One played a round of golf at Gulf Stream, which has a slope rating of 126 while Player Two played a round of golf at Merion, which has a slope rating of 148. The participants may designate either course played or some other virtual or real course as the Tournament course. In this example, the Tournament course has been designated as Player One's home course, Gulf Stream. Each player's Course Handicap is calculated using the following equation:

$$\text{Course Handicap} = \text{Player Handicap Index} \times (\text{Course Slope Rating}/113)$$

The calculated Course Handicap is rounded to the nearest whole digit. Based on the above equation, Player One gets 10 shots and Player Two gets 3 shots. Therefore, Player One gets 7 shots from Player Two.

Course rating adjustment compares the relative difficulty of the two courses. In this example, Gulf Stream has a course rating of 70.7 and Merion has a course rating of 73.5. The difference between these two courses is 2.8. Player Two gets 2.8 shots from Player One because Player Two's course is more difficult. Finally, the two adjustments are compared and rounded to the nearest whole number. In this example, the difference between the Course Handicap (+7) and the Course Rating (−2.8) is 4.2. Thus, Player One gets 4 shots from Player Two, which results in one shot on each of the four hardest holes.

After the handicap index adjustment and the course rating adjustment have been determined based on the course and slope ratings, the present invention determines which player has won depending on the particular golf game being played (e.g., stroke play, match play, etc.). As described above, the holes on each golf course are ranked from hardest to easiest. The hardest hole may be determined based on assigned handicap, hole length (the longest hole being the hardest), or by other methods known to those of ordinary skill in the art. The present invention then compares how each player did on their number 1 handicap hole (or hardest hole) relative to par. FIG. 5 illustrates this process. The holes are first rearranged and renumbered by hole handicap, hardest to easiest. One variation on this would be to weigh the holes based on assigned hole handicaps, contrived hole handicap (e.g., based on length), or the like and multiply the respective players' scores by some factor. For example, the respective scores on the hardest holes, or the deviation from par, could be multiplied by a factor of 18 while the easiest hole score, or deviation from par, could be multiplied by unity with the remainder of the holes multiplied by factors of 2 to 17 as appropriate.

If the players are engaged in stroke play, the winner is determined by comparing each score relative to par. On the hardest hole, Player One gets a bogie (1 over par) and Player Two also gets a bogie (1 over par). Both players tie the first hole. On the second hole, Player One gets a bogie and Player Two gets a par so now Player One is losing by one stroke or point. On the third hole, Player One gets a par and Player Two also gets a par. Player One is still losing by one stroke or point. On the fourth hole, Player One gets a double bogie (2 over par) while Player Two gets a par. Player One loses two strokes or points and is now losing by three strokes or points. This process is repeated for all 18 holes.

In another preferred embodiment of the present invention, the present invention is played with match play. Match play is different from stroke play since the winner of the match is determined by summing the total number of holes won by a player. A player wins a hole when that player's score for such hole is better than the other player's scores for such hole. Accordingly, instead of comparing a score of 4, 5, 6 etc. . . , the scores are compared against par for the hole played by each player (i.e., eagle, birdie, par, bogie, double bogie) to determine the winner of each hole. The number of strokes by which a player won a hole generally is not important in match play.

For example, to begin a match play game, the first played course is ordered by handicap next to the Tournament course which is also ordered by handicap. If the Tournament course is not the second played course, then the second played course is also ordered by handicap. The next step involves rearranging the list by the hole numbers of the Tournament course, similar to that shown in FIG. 4. After this manipulation has been performed, the match is determined not solely by number of strokes, but by score relative to par, i.e., eagle, birdie, par, bogie, double bogie. So if two players play even, with respect to individual handicap, and both par the number one handicap hole at their respective courses, they tie the hole. If Player One birdies, and Player Two gets a par, Player One wins that hole. In the alternative, if Player Two gets two shots from Player One (by the USGA handicap system) and both players par the number one handicap hole, Player Two wins that hole because of the one stroke received on that hole.

If the players are engaged in match play, the winner is determined by summing the total number of holes won by each player. In the example of FIG. 5, both players get a bogie and tie the first hole. Player Two wins the second hole. Both players tie the third hole. On the fourth hole, Player Two wins again. This process is repeated for all 18 holes. At the end, the player who won the most number of holes wins the match or game.

The examples based on FIG. 5 have assumed that both courses are rated even and the players have the same handicap. However, if the two players have different handicaps and the two courses have different slope and course ratings, the present invention will consider handicap index adjustment and course rating and slope adjustment. For example, suppose Player One receives 4 shots from Player Two based on the Handicap Index Adjustment and Course Rating Adjustment as shown in Table 1, then Player One receives one shot on each of the four hardest holes. As shown in FIG. 6, on the hardest hole (arranged as #1), Player One shoots one over par and Player Two also shoots one over par. Since this is the hardest hole, Player One gets one shot from Player Two, which means Player One wins that hole by one stroke. Based on player handicap, Player One pars that hole while Player Two gets one over par, a bogie. Thus, Player One wins that hole for match play. On the second hole, because Player One receives one stroke, both Player One and Player Two par and tie that hole.

FIG. 7 illustrates a flow chart showing the conversion and comparison process of an embodiment of the present invention. Step One of the present invention compares the relative difficulty of the different golf courses. The participant enters the Slope Ratings and the Players' Handicap Indices. The course handicap adjustment is calculated using the formula stated above. The participant then enters the Course Ratings. The course rating adjustment is calculated by taking the difference in Course Ratings. The number of shots to be allotted is determined by calculating the difference between course handicap adjustment and course rating adjustment.

Step Two rearranges the played courses and Tournament course. After the players have entered their scores for each hole, the present invention rearranges the courses by hole handicap, hardest to easiest. Also, the players' scores are adjusted based on the calculations of Step One.

Step Three determines the winner by comparing the scores to par for stroke play, match play or other methods of playing and competitively scoring games of golf.

In another preferred embodiment of the present invention, match play may be played with one or more players on each team (e.g., one on one, two on two, three on three, etc.). The winner may be determined by comparing the best score from each team and/or by the best combined score for each team. The following table illustrates a variation of match play.

TABLE 2

| | Hole Par = 3 | |
|---|---|---|
| | Team A | Team B |
| Player One | 2 | 3 |
| Player Two | 5 | 3 |

Best Score = Team A wins
Best Team Score = Team B wins

Player One from Team A gets a birdie (1 under par), Player Two from Team A gets a double bogie (2 over par), Player One from Team B gets a par, and Player Two from Team B also gets a par. If the winner is determined by the best score, Team A wins because Player One from Team A scored the best score. If the winner is determined by the best team score, Team B wins because a par combined with another par is better than a birdie combined with a double bogie.

Another variation of this game may include allotting 1 point for the best score and 1 point for the best team score where each hole may have a possible 2 points. As shown in Table 2, Team A receives 1 point for the best score and Team B receives 1 point for the best team score. Therefore, Team A and Team B tie this particular hole. Of course, respective player handicaps may also be taken into account when determining the outcome of each hole.

FIGS. 8 and 9 illustrate a hypothetical game between Player A and Player B comparing rounds of golf played, respectively, at golf courses of Country Club X and Country Club Y. As shown in the figures, the players' scores are compared against par for each hole played to arrive at a "difference" that represents the players' deviation from par for each hole. Note that for sake of this example the players' respective handicaps and the courses' respective slopes and ratings are ignored. As described elsewhere herein, the present invention may factor in such parameters to arrive at the winner of a competition or tournament. As shown in FIG. 9, the players' scores are arranged for comparison against the hole layout for the course of Country Club X. FIG. 9 shows the result of comparing the respective scores based on stroke play, in which Player B wins by one stroke, and match play, in which Player B wins the match one up. The system could also declare Player B the victor in match play 2 and 1 without considering the eighteenth hole because Player B was two holes up with one hole remaining to be played, thereby rendering the last hole superfluous.

In another preferred embodiment of the present invention, the Tournament course may be used for a virtual tournament. As an example, a web site or other central host may host a virtual tournament in which players from all over the country and perhaps all over the world compete in a round of golf where each participant may play at a different course. The web site or host can be used to collect the necessary information from each player, including the course information and the players' scores for each hole. After the necessary information has been collected for each player, the conversion described above is performed and the result is a multi-player virtual golf tournament where the golf rounds have actually been played in the physical world at a plurality of sites. Of course, particular course information may be maintained in or accessed from a central or third-party database, rather than requiring a player to input such course information.

Although many of the embodiments describe a method for comparing the scores of a plurality of players, the benefits of the present invention also may be enjoyed by a single player. After playing a round of golf at the local golf course, a player may want to see how he or she would have fared on a different course in the same community, in a different state or even in another part of the world. An embodiment of the present invention allows the player to take his or her score and predict what the score would have been on a different golf course.

In yet another embodiment, the method and system of the present invention compares two or more scores achieved at two or more courses by calculating respective course handicaps by applying the slope rating of the particular course played to the particular player's handicap to arrive at a course handicap to apply to that particular player's score. This is carried out for each of the players' scores being compared. The course rating for each of the courses played is then applied to arrive at a handicap factor to apply to the players' scores based on the differences among the various courses played. The method and system of the present invention then compares the respective course handicaps, the actual scores, and the course rating handicap factor to determine two or more adjusted player scores for comparing to determine the relative achievement of each player's round in comparison to the other of the two or more players. It is fully recognized that the particular method of processing some or all of the various course and player data may take many forms as fully contemplated by the present invention.

In another preferred embodiment of the present invention, the present invention allows users to compare past professional rounds. For example, Nicklaus scored a final round of 65 at the 1986 Masters Tournament and Palmer scored a final round of 65 at the 1960 US Open. Although the scores are identical, a dispute may arise as to who played the better game. Because the players played on different courses, it is difficult to determine who would have won had the players competed against each other. According to the present invention, the user may also compare the two performances on a different third "neutral" Tournament course. This allows the user to determine the players' performances relative to each other on an equal playing field.

The invention further allows for comparisons between past professional rounds during the same year against one another. For example, the performance of the winner of the 1998 US Open may be compared with the performance of the winner of the 1998 Masters. The comparison may also be performed on an entirely different Tournament course.

In another preferred embodiment of the present invention, the present invention allows a group of players to compete with and/or against a group of professional golfers. For example, one or more players may play a round of golf and compare their scores to that of a professional golfer or a group of professional golfers on a designated Tournament course. Also, tournaments may be played where the teams are made up of combinations of user-golfers and professional golfers.

In another preferred embodiment of the present invention, the present invention allows a player to participate in a fantasy golf game with a professional player in match play. The player "gets a pro" and may choose which round to use the professional golfer against the other professional golfers in match play competitions.

There are many different ways, games (e.g., Florida scramble, Nassau, Wolf, etc.), and formats with which to implement the present invention, such as intra-office competitions. For example, the finance department of a company may want to challenge the legal department of the same company to a game of golf. The department teams may play at different golf courses at different times. The present invention converts and compares the scores to determine the winner.

The present invention may be employed in conducting inter-office competitions. Most large companies have multiple offices located around the world. Thus, it is nearly impossible to host a company-wide golf tournament that accommodates everyone's schedules. The present invention allows a California office to play a friendly game of competitive golf against a New York office without having to fly across country and coordinate a tournament at a specific time and location. A company may desire to set up a dedicated web site at which a system utilizing the present invention is provided along with company and product information for use by employees, representatives and customers. The present invention also allows for multi-office competitions between different companies. In this instance, the information may be input into a single computer, as opposed to over a network, having software to perform the methods described herein to arrive at a virtual tournament winner.

The present invention also provides a means for getting participants to input useful information. The present invention may gather other pertinent information such as how far each player hit their drive on each hole, the number of putts taken on each hole, whether the drive ended in the rough, out of bounds, in the woods, in water or in the fairway. This information may be provided to the central server for processing as data or provided to players of virtual games of golf to aid in making certain decisions, such as selecting a partner on a given hole for a game such as "wolf." In addition to course and play information, other useful and valuable information may be gathered, such as what make of clubs, balls, attire, etc., participating players use. This type of information is particularly valuable for marketing and research. The present invention may provide a means for obtaining participants' personal and golf related information. Companies interested in subscribing to this information may provide prizes or other incentives for those who enter a drawing or contest in exchange for golf related and general personal information. Such information may include preferences in footwear, golf balls, golf clubs, golf courses and golf vacations. This information may then be sold to manufacturers and other interested businesses or may be used to meet the needs of the participants.

Figure 10:
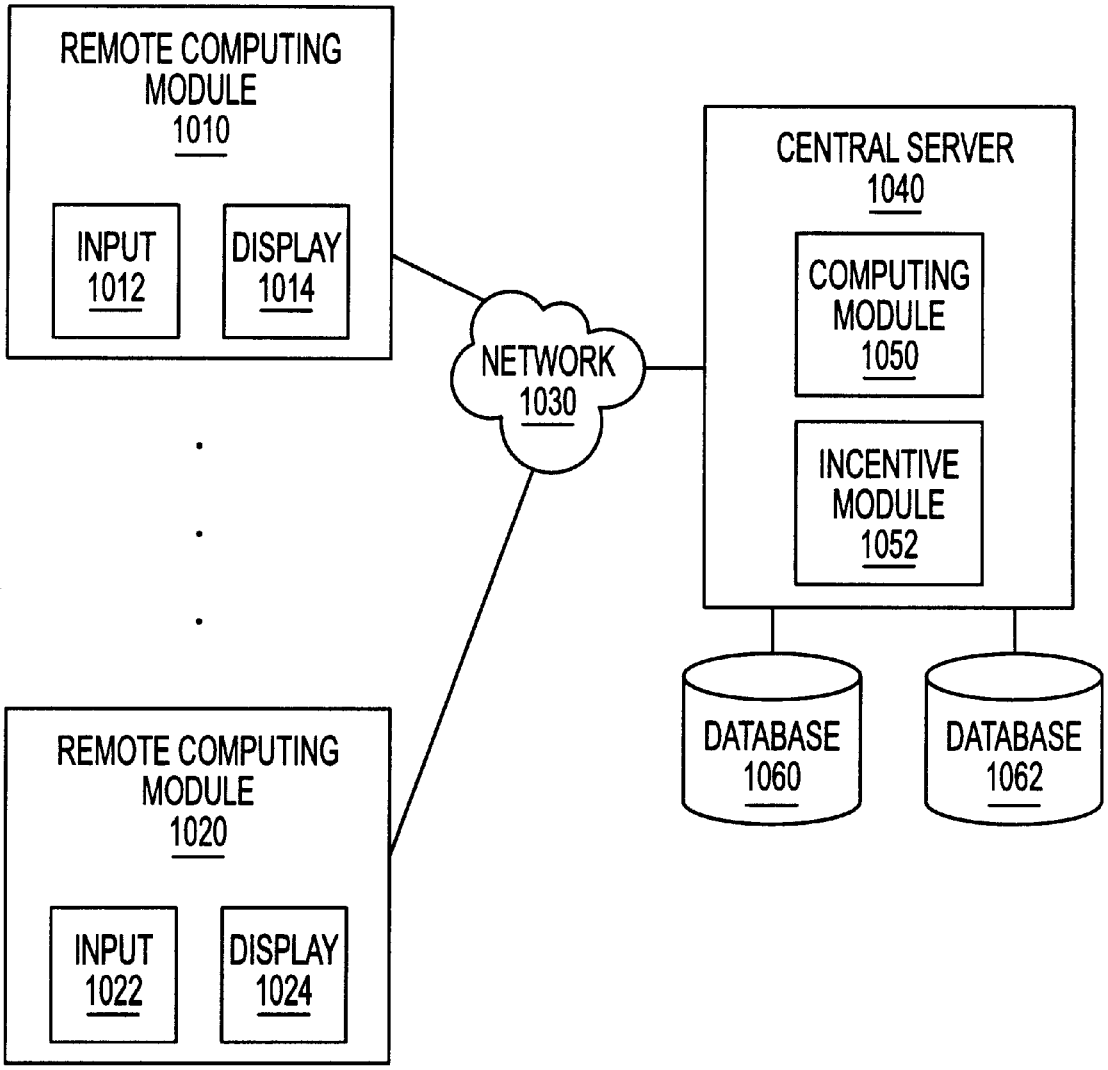
FIG. 10 is an example of a computer-based distributed network, according to an embodiment of the present invention.

FIG. 10 illustrates an example of a computer-based distributed network in which at least one remote user may participate in a game via at least one remote computing module, according to an embodiment of the present invention. System 1000 includes remote computing modules 1010 and 1020. Remote computing modules may further include input 1012, 1022 and display 1014, 1024. Remote computing modules may be adapted to transmit course, golfer and golfer scoring information to central server 1040. For example, a remote user may enter a tournament course selection at input 1012, 1022. Communication between remote computing modules and central server 840 may be accomplished via network 1030 wherein network 1030 may include Internet, World Wide Web, intranet, wide-area-network, local-area-network and Ethernet.

Central server 1040 may include computing module 1050 for comparing input data and determining a winner of a game. Computing module 1050 may perform a series of data comparisons and manipulations on selected course information and actual golf score information received from one or more game participants to determine the relative achievement of actual scores from different courses and determine a winner. Incentive module 1052 may present incentives as a reward for being determined the winner of a golf game as well as for participating in a golf game. In addition, incentives may be randomly presented to a plurality of participants of a golf game. In another example, participants may be presented with information, such as links to related web sites, advertisements, where particular information may be customized based on responses to data gathering queries.

Databases 1060, 1062 may receive and store course information relating to a plurality of golf courses including course par, slope rating, course rating, daily historical conditions, for example.

Figure 11:
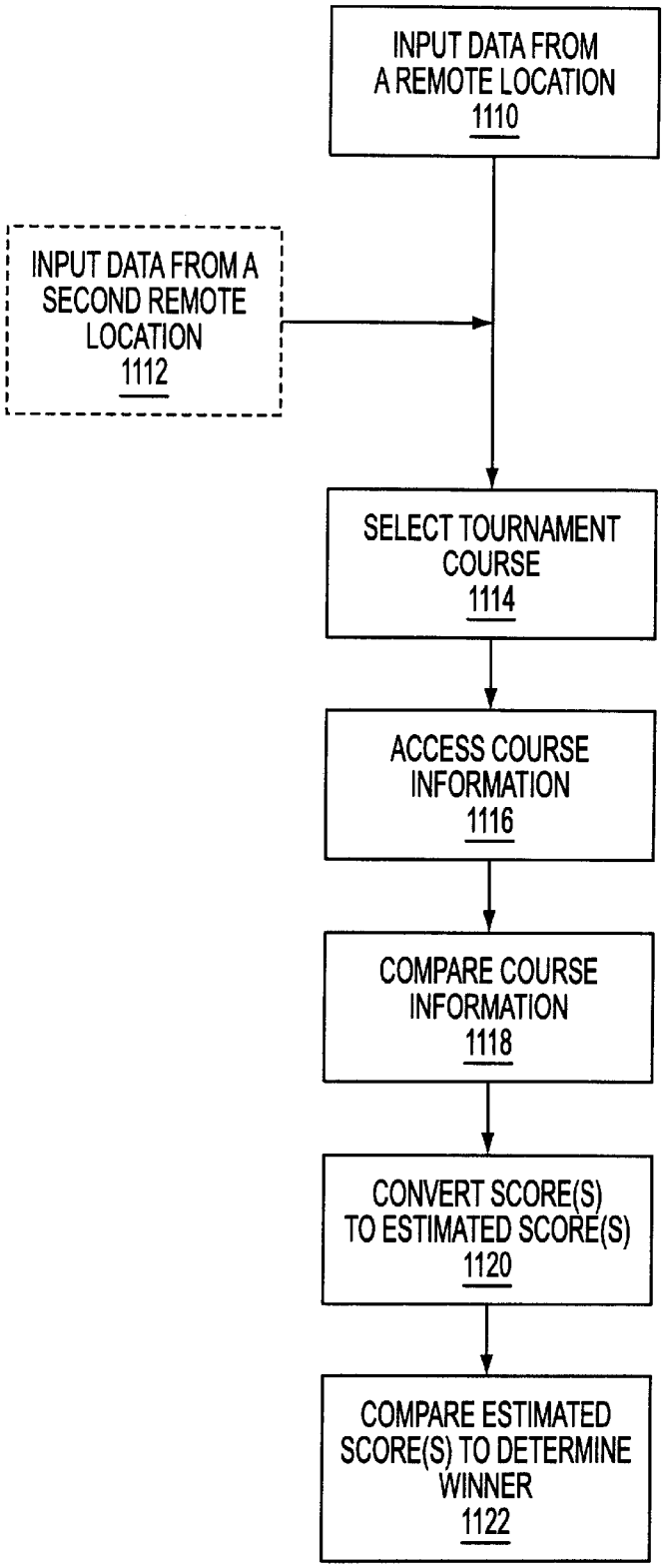
FIG. 11 is a flow chart illustrating a process for comparing golf scores, according to an embodiment of the present invention.

FIG. 11 is an example of a flowchart for comparing golf scores for one or more remote users, according to an embodiment of the present invention. At step 1110, a first user may input data from a first remote location. Input data may include a first actual golf score from a first round played at a first golf course. The present invention may support a game for a single remote user and a plurality of remote users. According to another embodiment of the present invention, a second user may input data from a second remote location wherein input data may include a second round played at a second golf course, at step 1112. In addition, input data may include personal golfer information which may include player handicap, buying preferences, and personal demographic information, for example.

At step 1114, a tournament course may be selected for determining an estimated score or scores. Tournament course selection may occur at a central server. In addition, tournament course selection may occur at one or more remote locations and transmitted to a central server.

At step 1116, course information may be accessed from a database or provided by a central server. Course information may include at least one of course par, slope rating, course rating and daily historical weather conditions. In addition, one or more handicap adjustment factors may be applied to one or more golf scores.

At step 1118, course information of a first golf course (and second golf course, if multiple players) may be compared with the course information of the tournament course. A conversion factor may be determined by comparing course information.

At step 1120, scores may be converted to one or more estimated scores. This step may be accomplished by applying a conversion factor to an actual score to an estimated score. The estimated score represents the score a player would have had the player's round been played at the tournament course.

At step 1122, the estimated scores may be compared to determine a winner based on the estimated scores. The winner may be determined based on match play and/or stroke play.

Other embodiments and uses of the invention will be apparent to those skilled in the art from consideration of the specification and practice of the invention disclosed herein. The specification and examples should be considered exemplary only. The intended scope of the invention is only limited by the claims appended hereto.

What is claimed is:

1. An online method for comparing a plurality of actual golf scores in which a plurality of remote users access a central server adapted to convert an actual golf score from a round of golf played at a golf course to an estimated score relating the actual score to a selected tournament course, the method comprising the steps of:

inputting at a first remote location a first actual golf score from a first round played at a first golf course and transmitting the first golf score to the central server;

inputting at a second remote location a second actual golf score from a second round played at a second golf course and transmitting the second golf score to the central server;

selecting the tournament course for determining estimated scores; and applying the course information of the first, second, and tournament golf courses to the first and second actual golf scores to convert the first and second actual scores to first and second estimated scores, respectively representing the relative achievement of the first and second players actual scores, the course information including at least one of: course par, slope rating, course rating, and daily historical weather conditions.

2. The method of claim 1, wherein the tournament course is the first golf course and the central server converts the second golf score to the second estimated score based on comparing the course information associated with the first and second courses.

3. The method of claim 1 further comprising the step of inputting at the first and second remote locations first and second personal golfer information, respectively, and transmitting the first and second personal golfer information to the central server.

4. The method of claim 3 further comprising the step of applying the first and second personal golfer information to determine first and second personal golfer conversion factors, respectively, and applying the first and second conversion factors to the first and second actual scores, respectively, to further convert the actual scores to arrive at the first and second estimated scores.

5. The method of claim 3, wherein the first and second personal golfer information includes first and second players' handicaps.

6. The method of claim 3, wherein the first and second personal golfer information includes at least one of personal buying preferences and personal demographic information.

7. The method of claim 1 wherein the step of selecting the tournament course is conducted at one of the first and second remote locations and the tournament course selection is transmitted to the central server.

8. The method of claim 1 wherein the step of selecting the tournament course is conducted at the central server.

9. The method of claim 1 further comprising the step of inputting course information at a remote location and transmitting the input course information to the central server.

10. The method of claim 9, wherein the transmitted course information is stored and maintained at the central server.

11. The method of claim 1, wherein the first and second actual golf scores comprise first and second rounds of 18 separate and discreet hole scores and the central server is adapted to convert the first and second rounds to first and second estimated rounds and to compare on a hole-by-hole basis each of the 18 first estimated hole scores with the 18 second estimated hole scores to determine the winner of a virtual golf game between the first and second golfers.

12. The method of claim 1, wherein the central server is adapted to determine the winner of at least one of a group of games consisting of match play and stroke play.

13. The method of claim 1, wherein the first golf score comprises two or more individual scores of a first team comprising two or more golfers and the second golf score comprises two or more individual scores of a second team comprising two or more golfers, and the central server is adapted to convert the individual scores of the first and second golf scores into first and second converted team scores and compare the converted golf scores to determine the winner of a golf game.

14. The method of claim 13, wherein the central server is adapted to determine the winner of a golf game by applying at least one of the following comparisons:

the lowest converted individual score of the first converted team score is compared with the lowest converted individual score of the second converted team score; and the total of the converted individual scores of the first converted team score is compared with the total of the converted individual scores of the second converted team score.

15. The method of claim 1, wherein the step of applying course information includes comparing first and second course ratings to arrive at a first handicap adjustment factor to apply to the first and second golf scores.

16. The method of claim 1 further comprising the step of inputting at the first and second remote locations first and second personal golfer information, respectively, and transmitting the first and second personal golfer information to the central server, the personal golfer information including a player's handicap index, and wherein the step of applying course information includes applying first and second course slope ratings to the first and second players' handicap indices, respectively, to determine first and second player course handicaps and comparing the first and second player course handicaps to arrive at a second handicap adjustment factor to apply to the first and second golf scores.

17. The method of claim 16, wherein the step of applying course information includes comparing first and second course ratings to arrive at a first handicap adjustment factor to apply to the first and second golf scores.

18. The method of claim 1, wherein the online method is performed over at least one of a group consisting of: Internet, World Wide Web, intranet, wide-area-network, local-area-network, and Ethernet.

19. The method of claim 1 further comprising the step of comparing the first and second estimated scores to determine the winner of a virtual game of golf.

20. An online method for a remote user to access a central server adapted to convert an actual golf score from a round of golf played at a first course to an estimated score relating the actual score to a second course, the method comprising the steps of:

inputting at a remote location an actual golf score from a round played at a first golf course and transmitting the golf score to a central server;

selecting a second course and transmitting the selection from the remote location to the central server; and providing the central server with course information relating to the first and second courses and comparing the course information of the first course with the course information of the second course to determine a conversion factor and applying the conversion factor to the actual score to convert the actual score to an estimated score relating the actual score to the selected second course, the course information including at least one of: course par, slope rating, course rating, and daily historical weather conditions.

21. The method of claim 20 further comprising the step of inputting at the remote location personal golfer information and transmitting the personal golfer information to the central server.

22. The method of claim 21 further comprising the step of applying the personal golfer information to determine a second conversion factor and applying the second conversion factor to further convert the actual score to an estimated score.

23. The method of claim 22, wherein the personal golfer information includes a player's handicap index.

24. The method of claim 21, wherein the personal golfer information includes at least one of personal buying preferences and personal demographic information.

25. The method of claim 20, wherein the online method is performed over one of the following: Internet, World Wide Web, intranet, wide-area-network, local-area-network, and Ethernet.

26. A computer-based distributed network in which a plurality of remote users participate in a game by communicating information to a central server via at least one remote computing means, the network comprising:

a central server having a first computing means and a central database, the central server being adapted to receive and store course information relating to a plurality of golf courses, the course information including at least one of: course par, slope rating, course rating, and daily historical weather conditions for each of the plurality of golf courses;

the at least one remote computing means having input means and being in communication with the central server, the remote computing means being adapted to transmit course, golfer and golfer scoring information to the central server, the golfer scoring information including a first golf score at a first course and a second golf score at a second course; and the first computing means being adapted to access information relating to the first and second courses from the central database and convert at least one of the first golf score and the second golf score based on the course information relating to the first and second courses, the first computing means being adapted to compare the first and second golf scores, as converted, to determine a winner of a golf game.

27. The network of claim 26, wherein the central database includes course information relating to a tournament course, the first computing means is adapted to convert the first and second golf scores based on the course information relating to the first, second and tournament courses, and the first computing means compares the converted first and second golf scores to determine a winner of a golf game.

28. The network of claim 27, wherein at least one remote user selects the tournament course, the remote computing means is adapted to transmit the tournament course selection instructions to the central server, and the first computing means is adapted to convert the first and second golf scores to first and second tournament scores, respectively.

29. The network of claim 26, wherein the first course is a tournament course for determining the winner of the golf game, and the first computing means converts the second golf score to a tournament score based on comparing the course information associated with the first and second courses.

30. The network of claim 29, wherein the first golf score comprises a first round of 18 separate and discreet first golfer hole scores and the tournament score comprises a second round of 18 separate and discreet tournament hole scores, and the first computing means is adapted to compare on a hole-by-hole basis each of the 18 first golfer hole scores with the 18 tournament hole scores to determine the winner of a golf game between the first and second golfers.

31. The network of claim 30, wherein the first computing means is adapted to determine the winner of at least one of a group of games consisting of match play and stroke play.

32. The network of claim 26, wherein the first golf score comprises two or more individual scores of a first team comprising two or more golfers and the second golf score comprises two or more individual scores of a second team comprising two or more golfers, and the central server is adapted to convert the individual scores of the first and second golf scores into first and second converted team scores and compare the converted golf scores to determine the winner of a golf game.

33. The method of claim 32, wherein the central server is adapted to determine the winner of a golf game by applying at least one of the following comparisons:

the lowest converted individual score of the first converted team score is compared with the lowest converted individual score of the second converted team score; and the total of the converted individual scores of the first converted team score is compared with the total of the converted individual scores of the second converted team score.

34. The network of claim 26, wherein the plurality of remote users communicate with the central server via one of the following: Internet, World Wide Web, intranet, wide-area-network, local-area-network, and Ethernet.

35. An online method for obtaining personal information, including at least one of buying preferences and demographic related information, from a plurality of participants of an online, virtual golf game, the method comprising the steps of:

providing a central server having a central database containing information pertaining to a plurality of golf courses, the database including one or more of course par, USGA course rating, USGA slope rating, and daily historical weather condition data associated with the plurality of golf courses, the central server being adapted to perform a series of data comparisons and manipulations on selected course information and actual golf score information received by the central server from the plurality of game participants to determine the relative achievement of actual scores from different courses and determine a winner of a golf game;

providing access to the central server to a plurality of remote computing means at a plurality of remote locations, the remote computing means having input means and user viewing means and being adapted to transmit course and player score data to the central server; and providing, via the viewing means, the plurality of participants with a series of data gathering queries, whereby participants operate the input means to provide personal information in response to the data gathering queries in conjunction with accessing the central server to effect a golf game.

36. The method of claim 35 further comprising the step of presenting the plurality of participants with at least one incentive as a reward for being the winner of the golf game.

37. The method of claim 35 further comprising the step of presenting the plurality of participants with at least one incentive as a reward for participating in the golf game.

38. The method of claim 35 further comprising the step of randomly presenting the plurality of participants with an incentive for participating in the golf game.

39. The method of claim 35 further comprising the step of presenting the plurality of participants with golf related advertisements in conjunction with participating in a golf game.

40. The method of claim 35 further comprising the step of presenting the plurality of participants with a plurality of links to golf related web sites in conjunction with participating in a golf game.

41. The method of claim 35 further comprising the step of presenting the plurality of participants with at least one of the group consisting of incentives, advertisements, and web site links, in which the particular items presented are customizable based upon the particular individual's responses to the data gathering queries.

42. An online method for comparing two or more actual golf scores achieved at two or more courses comprises the following steps:

calculating respective course handicaps for each actual golf score by applying the slope rating of the particular course played to the particular player's handicap having played that course to arrive at a course handicap for that particular golfer and that particular course, and respectively applying to each of the actual golf scores the respective calculated course handicap; and determining a baseline tournament course rating and respectively applying the baseline course rating to each course rating for each of the courses played to arrive at a handicap factor to apply to the players' scores.

43. The method of claim 42 further comprising the step of comparing the respective course handicaps, the actual scores, and the course rating handicap factor to determine two or more adjusted player scores corresponding, respectively, to each of the two or more actual golf scores, and comparing the two or more adjusted player scores to determine the relative achievement of each player's round in comparison to the other of the two or more players.

44. An online method for determining the winner of a virtual golf game based on actual golf scores achieved by game participants in which a plurality of remote users access a central server adapted to store and maintain course information relating to a plurality of golf courses and to convert an actual golf score from a round of golf played at a golf course to an estimated score had that round been played at a selected tournament course, the method comprising the steps of:

inputting at a first remote location a first actual golf score from a first round played at a first golf course and transmitting the first golf score to a central server;

inputting at a second remote location a second actual golf score from a second round played at a second golf course and transmitting the second golf score to a central server;

selecting a tournament course from the plurality of golf courses;

accessing course information stored at the central server relating to the first and second golf courses and the tournament golf course, the course information including at least one of: course par, slope rating, course rating, and daily historical weather conditions;

comparing the course information of the first and second golf courses with the course information of the tournament golf course to determine a conversion factor and applying the conversion factor to the first and second actual scores to convert the first and second actual scores to a first and second estimated score, respectively representing the score that the first and second players would have had the first and second rounds been played at the tournament course; and comparing the first and second estimated scores to determine the winner of a virtual game of golf.

* * * * *